US008919048B2

(12) United States Patent
Uetabira

(10) Patent No.: US 8,919,048 B2
(45) Date of Patent: Dec. 30, 2014

(54) MOBILE TERMINAL BOOTH

(71) Applicant: INTERMAN Corporation, Kagoshima (JP)

(72) Inventor: Shigeki Uetabira, Kagoshima (JP)

(73) Assignee: Interman Corporation, Kagoshima (JP)

( * ) Notice: Subject to any disclaimer, the term of this patent is extended or adjusted under 35 U.S.C. 154(b) by 0 days.

(21) Appl. No.: 13/954,636

(22) Filed: Jul. 30, 2013

(65) Prior Publication Data

US 2014/0033620 A1 Feb. 6, 2014

(30) Foreign Application Priority Data

Jul. 31, 2012 (JP) ..... P2012-169101

(51) Int. Cl.

| | |
|---|---|
| ***A47F 10/00*** | (2006.01) |
| ***E04H 1/00*** | (2006.01) |
| ***E04H 1/14*** | (2006.01) |
| ***E04B 1/82*** | (2006.01) |

(52) U.S. Cl.

CPC ..... *E04H 1/14* (2013.01); *E04B 1/8209* (2013.01)

USPC ..... 52/36.1; 52/36.2; 52/27.5; 52/145; 52/268; 52/309.5

(58) Field of Classification Search

USPC ..... 52/36.1, 36.2, 27.5, 145, 73, 268, 270, 52/144, 309.5; 108/60; 156/265, 266

See application file for complete search history.

(56) References Cited

U.S. PATENT DOCUMENTS

| | | | | | |
|---|---|---|---|---|---|
| 2,328,618 | A | * | 9/1943 | Corso | 52/262 |
| 2,337,885 | A | * | 12/1943 | Hallam | 52/28 |
| 2,397,606 | A | * | 4/1946 | Hoyle | 52/145 |
| 2,397,609 | A | * | 4/1946 | Leadbetter | 52/145 |
| 3,728,801 | A | * | 4/1973 | Beckman et al. | 434/314 |
| 3,869,992 | A | * | 3/1975 | Kramer | 108/60 |
| 5,182,883 | A | * | 2/1993 | Amberson et al. | 52/73 |

FOREIGN PATENT DOCUMENTS

| | | |
|---|---|---|
| WO | 2006/134654 A1 | 12/2006 |
| WO | 2012/137353 A1 | 10/2012 |

* cited by examiner

*Primary Examiner* — Chi Q Nguyen

(74) *Attorney, Agent, or Firm* — Maier & Maier, PLLC

(57) ABSTRACT

A mobile terminal booth which provides an area where a mobile terminal can be comfortably used is described. This mobile terminal booth is provided with a sound absorbing unit which is placed in a public place and partially partitions a space as viewed from the above where a user of a mobile terminal can have a telephone conversation. The sound absorbing unit is provided with an entrance which is always opened without any closing member. The sound absorbing unit is made of a laminate consisting of a plurality of sound absorbing layers, and serves as a sound controlling means. Particularly, the sound absorbing layers are joined together in the form of the laminate with a viscous adhesive which does not solidify after formation of said laminate, maintains its viscosity when the mobile terminal booth is used and functions as said sound controlling member.

27 Claims, 18 Drawing Sheets

MOBILE TERMINAL BOOTH

CROSS-REFERENCE TO RELATED APPLICATIONS

The present application claims priority under 35 U.S.C. §119 to Japanese Patent Application No. P2012-169101, filed Jul. 31, 2012. The contents of this application are herein incorporated by reference in their entirety.

FIELD OF INVENTION

The present invention relates to a mobile terminal booth for providing an area where a mobile terminal can be comfortably used in a public area or the like.

DESCRIPTION OF RELATED ART

Currently, the penetration rate of cellular phones and smartphones has exceeded 100 percent of the Japanese population, and almost all the Japanese have communication devices at all times. Such mobile terminals are convenient to make it possible to collect and transmit information or have telephone conversations, for example, by using spare time effectively on the move. In fact, a significant proportion of people in a park, a building, a street or the like public area are using mobile terminals for some purposes.

However, when a person has a telephone conversation on the move with a mobile terminal, it is common that the person talks beside other passengers, unlike having a telephone conversation with a public phone in a telephone booth. Accordingly, it is often difficult to hear the other person's voice in loud places, e.g., in a crowded street.

Even in a station yard or in a building, noise tends to be reverberating in the enclosed space so that it is sometimes difficult to talk in a relaxed way. Usually, when having a telephone conversation, a person moves close to a wall or the like where noise seems to be smaller. The noise level near a wall, however, is never small because of reverberating sound reflected from the wall. The reverberating sound often makes it difficult also for the person at the other end to hear the voice. On the other hand, however, it is not a good idea to have a conversation in the middle of a walkway.

Also, since the conversation may be heard by others nearby, there is some reluctance to talk a personal fact. Furthermore, it is not well-mannered and often an annoyance to other passengers to use a mobile terminal or have telephone conversation while walking.

There are commercially available booths for cellular phones similar to conventional public phone rooms. These booths or conventional public phone rooms are cuboid boxes forming an enclosed space with a door provided in one side for entry. The sides of such a box are formed of transparent walls such as glass plates from the viewpoint of security and giving the space an open feeling. The inside space is completely confined and separated from outside because it is believed that a noiseless space is created by eliminating any sound passage between the inner space and the outside.

However, this consideration is not true at least in the case where a comfortable space is wanted for the purpose of using a mobile terminal. The confined structure forms a reverberation space in which noise is reverberating. The sound entering through the glass plates is not so large, but tends to make an inside person feel loud the reverberation. Particularly, the voice and other sound output from this inside person also become such reverberating noise. Also, a substantial space has to be prepared in order to install such a box provided with a door. space has to be spared In addition, the production cost is relatively high. Furthermore, it seems somewhat heavy to install and use the box for the purpose of using a mobile terminal.

It is therefore an object of the present invention to provide a mobile terminal booth which can be used for having telephone conversation with comfort, less stress and no hesitation.

SUMMARY OF THE INVENTION

To achieve at least one of the abovementioned objects, mobile terminal booth comprises: a sound absorbing unit which is placed in a public place and partially partitions a space as viewed from the above where a user of a mobile terminal can have a telephone conversation, wherein said sound absorbing unit is provided with an entrance which is always opened without any closing member, wherein said sound absorbing unit is provided with a sound controlling member.

In accordance with a preferred embodiment, said sound absorbing unit includes a sound absorbing layer.

Also, in a preferred embodiment, said sound absorbing layers are made from at least one of a needle felt, bestray, softray, glass wool, thermo wool, phenol resin, and polyurethane.

In accordance with a preferred embodiment, said sound absorbing unit is made of a laminate consisting of a plurality of sound absorbing layers, and said sound absorbing layers are joined together in the form of said laminate with an adhesive.

Furthermore, in a preferred embodiment, said adhesive is a viscous adhesive which does not solidify after formation of said laminate, maintains its viscosity when the mobile terminal booth is used and functions as said sound controlling member.

Furthermore, in a preferred embodiment, said laminate is formed with a resin sheet interposed between each adjacent ones of said sound absorbing layers.

Furthermore, in a preferred embodiment, said resin sheet is a vinyl film having a thickness of 0.1 mm to 0.5 mm.

Furthermore, in a preferred embodiment, said resin sheet is provided with a plurality of openings, wherein said sound absorbing layers are directly adhered with each other by said adhesive through said openings, and indirectly adhered with each other by said adhesive through said resin sheet.

Furthermore, in a preferred embodiment, the mobile terminal booth further comprises a plurality of support posts which support said sound absorbing unit at a predetermined height.

Furthermore, in a preferred embodiment, said sound absorbing unit consists of a plurality of sound absorbing panels which are joined to confine said partitioned space.

Furthermore, in a preferred embodiment, said sound absorbing panel includes a sound absorbing member and a support panel on which said sound absorbing member is mounted, and the outer side of said support panel is at least partially opened.

Furthermore, in a preferred embodiment, the outer side of said support panel serves as a sound blocking surface.

Furthermore, in a preferred embodiment, said support panel is made of aluminum.

Furthermore, in a preferred embodiment, the mobile terminal booth further comprises a roof member which covers the top of said mobile terminal booth and encloses the inside space of said mobile terminal booth from the above.

Furthermore, in a preferred embodiment, said sound absorbing unit is in the form of an arc in a plan view.

Furthermore, in a preferred embodiment, said sound absorbing unit is in the form of a polygon in a plan view.

Furthermore, in a preferred embodiment, said polygon is a rectangle, a square or a pentagon, whose one side is at least partially opened.

BRIEF DESCRIPTION OF THE DRAWINGS

The objects and features of the present invention will become more apparent from consideration of the following detailed description taken in conjunction with the accompanying drawings in which.

DETAILED DESCRIPTION OF THE PREFERRED EMBODIMENT

In what follows, a mobile terminal booth in accordance with several embodiments of the present invention will be explained with reference to the accompanying drawings. This mobile terminal booth can be installed in a station yard, a lobby, a street or the like. When making a call, a user of a cellular phone can get away from reverberating sound by entering this mobile terminal booth. It is possible to prevent the conversation from being heard by others nearby. Furthermore, the user can enjoy the conversation without worrying about other people who might be looking at the user.

[Embodiment 1]

Figure 1:
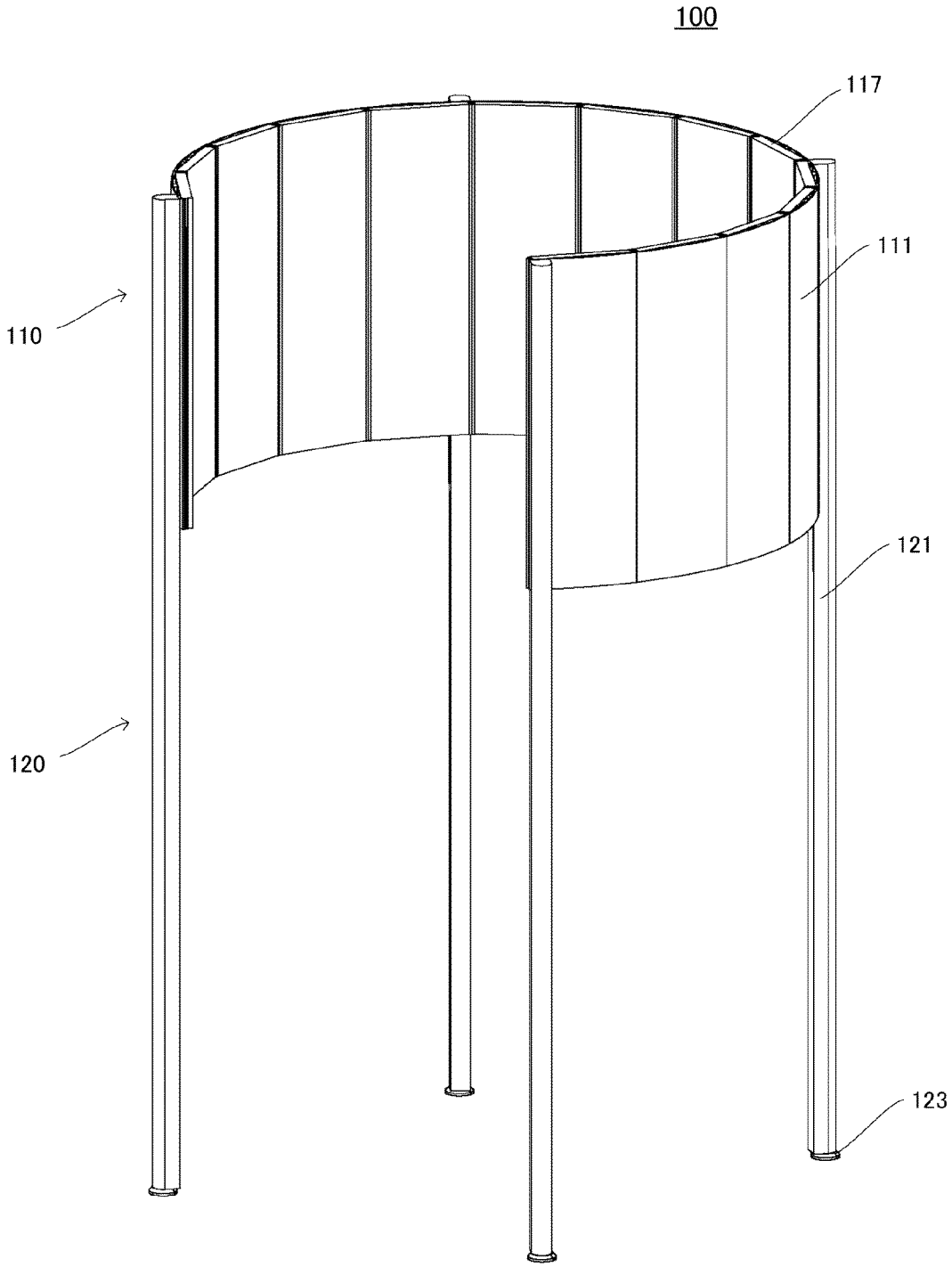
FIG. 1 is a perspective view for showing a mobile terminal booth in accordance with an embodiment 1 of the present invention.

FIG. 1 is a perspective view for showing a mobile terminal booth in accordance with a first embodiment of the present invention. This mobile terminal booth 100 includes a sound absorbing unit 110 in the form of a cylinder having a front opening, and a support frame 120 for supporting the sound absorbing unit 110. Each of the sound absorbing unit 110 and the support frame 120 can be carried as several constituent parts and assembled in an installation site.

The sound absorbing unit 110 can be assembled by connecting a number of plate-like sound absorbing panels 111 in the form of an arch. Each sound absorbing panel is, for example, 20 cm wide, 60 cm high and 3 cm thick. Also, the support frame 120 includes four pipes (support posts) to be vertically connected to the sound absorbing unit 110, and adjuster foots 123 attached to the bottom surfaces of the pipes 121.

If the length of the pipes 121 is 180 cm, the lower end of the sound absorbing unit 110 is located 120 cm from the floor. The sound absorbing unit 110 is effective when it is taller than the user of this mobile terminal booth 100. Generally speaking, the upper end of the plate-like sound absorbing panel 111 is located 10 to 15 cm higher than the average height of the country where the mobile terminal booth 100 is installed.

Figure 2:
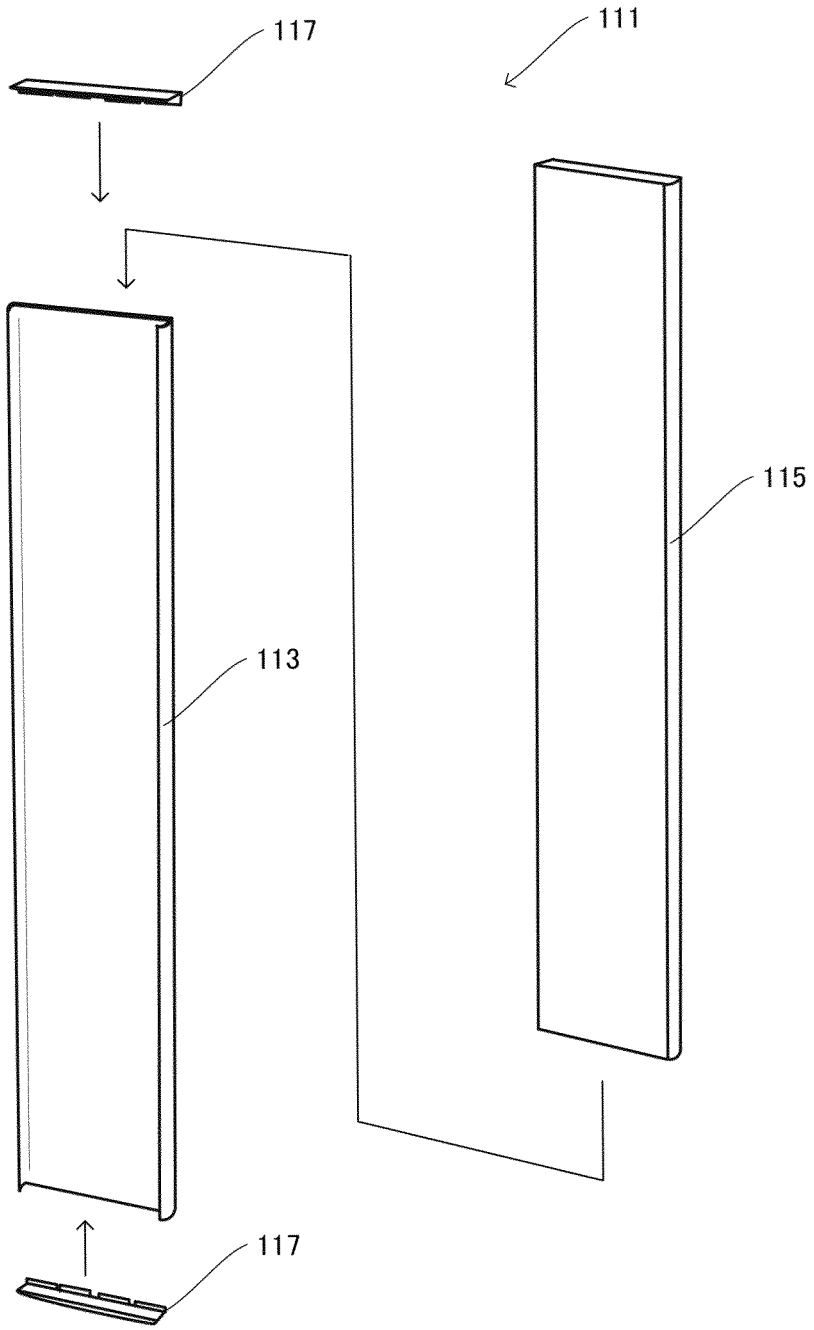
FIG. 2 is an exploded perspective view for showing the structure of the plate-like sound absorbing panel in accordance with the embodiment 1 of the present invention.

As illustrated in FIG. 2, the plate-like sound absorbing panel 111 is assembled by mounting a sound absorbing member 115 on an aluminum panel (support panel) 113. This sound absorbing member 115 is "Room Creator" which House 119 co. Ltd. has sold. After mounting the sound absorbing member 115 on the aluminum panel 113, panel caps 117 are fitted onto the top and bottom ends of the aluminum panel 113. Also, as illustrated in FIG. 1, a plurality of the plate-like sound absorbing panel 111 are connected to each other as the sound absorbing unit 110 in the form of a cylinder having an opening in the front side. In this case, the angle subtended by the opening and as seen from the center of the cylinder is 90 to 120 degrees, i.e., ¼ to ⅓ of the circumference. This angle range is important for this purpose and has been found by the inventor through experiments.

Generally speaking, the term "sound insulation" has two meanings. One of them is absorption capabilities of absorbing sound waves incident on the panel by converting the incident sound waves to thermal energy. The other is reflection capabilities of blocking sound waves incident on the panel by reflecting the incident sound waves and preventing them from entering inside.

Both are effective to prevent sound from leaking one side to the other side. What required of a sound insulating wall is to prevent sound from leaking one side to the other side. However, when enjoying music and so forth, sound reverberates with the sound insulating wall so that the space becomes not comfortable, and the bandwidth of reproduced sound is narrowed.

When a person is about to use a cellular phone, he often moves to a position near a wall or a corner which seems relatively noiseless. However, such a position is not a better position in terms of a sound environment because sound reverberation occurs particularly near walls. Accordingly, from the viewpoint of the purpose, the absorption capabilities are particularly important.

Figure 3:
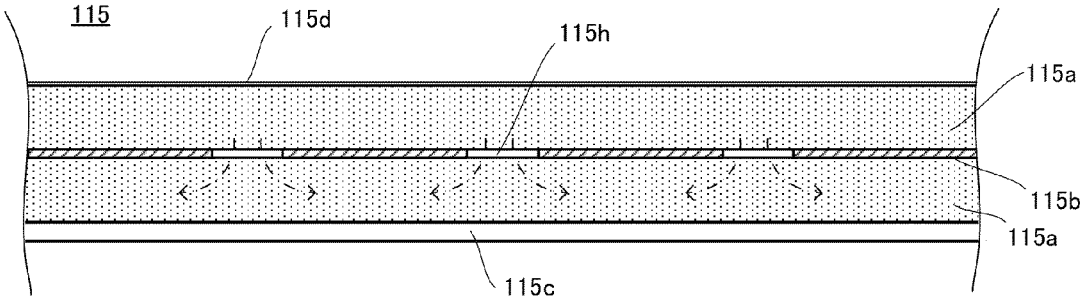
FIG. 3 is a cross sectional view for showing the sound absorbing structure of a sound absorbing member used in the mobile terminal booth of the embodiment 1.

FIG. 3 is a cross sectional view for showing the sound absorbing structure of "Room Creator" (sound absorbing member 115). The Room Creator is an excellent sound controlling material used in the mobile terminal booth of the embodiment 1. The sound absorbing structure includes a pair of sound absorbing sheets 115*a* bonded as a laminate together with an intervening thin vinyl film 115*b* therebetween. The vinyl film 115*b* functions as a sound scattering. The sound absorbing sheet 115*a* is made of a needle felt which functions as a sound absorbing material. Other sound absorbing material which can be used for this purpose includes glass wool, thermo wool, bestray, softray, phenol resin, and polyurethane. The thickness of the sound absorbing sheet 115*a* is for example 1 to 2 cm, and the thickness of the vinyl film 115*b* is for example 0.1 mm through 0.5 mm. Furthermore, the back side of the sound absorbing member 115 is covered by a soft polyvinyl chloride plate 115*c* for the purpose of supporting and protecting the sound absorbing member 115. Also, the other inner side is covered by a cloth 115*d*. The total thickness of the sound absorbing member 115 is thereby about 2 to 4 cm.

Figure 4:
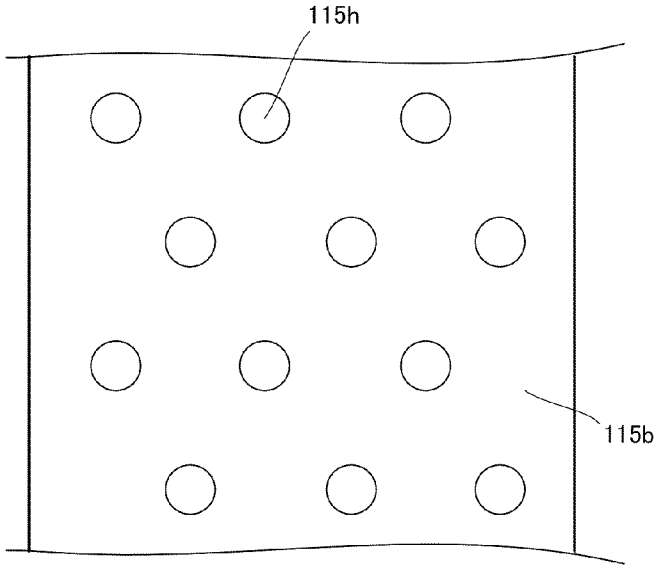
FIG. 4 is a plan view for showing a vinyl film which is inserted between the sound absorbing member shown in FIG. 3 and through which a number of openings are formed.

FIG. 4 is a plan view for showing the vinyl film 115*b* which is inserted between the sound absorbing members 115 shown in FIG. 3 and through which a number of openings 115*h* are formed. For example, the diameter of each opening 115*h* is 2 cm, and adjacent ones thereof are located 7 cm distant from each other. With the openings 115*h*, the incident sound waves can be effectively scattered in the lateral direction to enhance the sound absorbing capabilities of the sound absorbing member 115. In addition, the openings 115*h* allow part of the incident sound waves to pass through the vinyl film 115*b* to control the balance between reflection and transmission, such that they functions as a sound controlling means.

The vinyl film 115*b* and the sound absorbing sheets 115*a* are joined with a viscous adhesive. The viscous adhesive is applied also between the sound absorbing sheets 115*a* through the openings 115*h*. While binding the vinyl film 115*b* and the sound absorbing sheets 115*a* together, this viscous adhesive maintains a certain viscosity. Also, while maintaining a certain viscosity, this viscous adhesive intervenes between the sound absorbing sheets 115*a* through the openings 115*h*. In other words, it is important that, when the sound absorbing member 115 is used, the viscous adhesive shall not be solidified but can provide a glutinous layer between the vinyl film 115*b* and the sound absorbing sheets 115*a* and between the sound absorbing sheets 115*a*.

This sound absorbing structure is described in International Patent Application No. PCT/JP2011/58944, and capable of absorbing incident sound waves in a wide range from very low frequencies to very high frequencies. Particularly, for this purpose, it is important that the sound absorbing structure can substantially dump sound pressure levels at 500 Hz or higher frequencies which phone users feels noisy. On the other hand, it is considered difficult to maintain sound absorbing capabilities at low frequencies. Even if only high frequency components are dumped, it is an unnatural sound environment so that when entering the booth, the user feels somewhat incommodity. Contrary to this, if sound components are uniformly dumped, the user feels a natural sound environment and, even though confined, receive the impression that the space is expanded.

The sound absorbing member 115 may be formed by the use of the sound absorbing structure as described in International Patent Published Application (WO2006/134654). This sound absorbing structure is characterized in that the incident sound waves are passed through a passage constructed by a wall whose cross section is gradually decreased from the sound entry side. That is, the opening area of the passage perpendicular to the direction of the incident sound waves is gradually decreased from the sound entry side to form a narrowing passage. This structure is useful in that it can absorb wide band sound waves.

Figure 5:
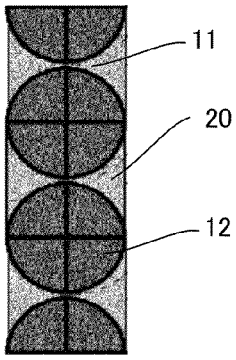
FIG. 5 is a cross sectional view for showing the sound absorbing structure as described in International Patent Published Application (WO2006/134654).

FIG. 5 is a cross sectional view for showing the sound absorbing structure as described in International Patent Published Application (WO2006/134654). As illustrated in FIG. 5, a number of cylindrical sound absorbing members 12 are arranged in parallel with each other perpendicular to the plane of the drawing sheet. A sound absorbing material 20 is provided with to fill the space between each adjacent ones of the cylindrical sound absorbing members 12. In this case, each cylindrical sound absorbing member 12 is a cylinder made of an acrylate resin. The cylindrical sound absorbing members 12 are slightly distant from each other to form a narrowing passage 11 which is filled with the sound absorbing material 20. The longitudinal direction of the sound absorbing members 12 is aligned with in the longitudinal direction of the plate-like sound absorbing panel 111, which is then covered with a fabric to make up the sound absorbing member 115.

The reverberating sound can be dumped in the mobile terminal booth by the use of the sound absorbing member 115 as described above to make it possible to have telephone conversation in a quiet environment.

Figure 6:
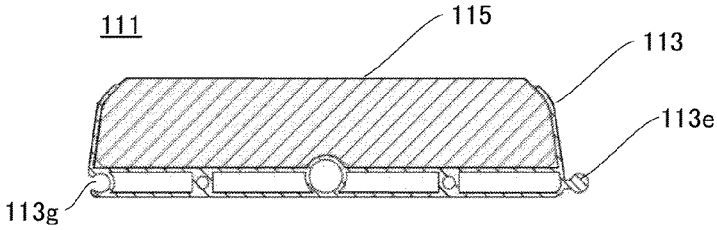
FIG. 6 is a cross sectional view for showing the structure of the plate-like sound absorbing panel used in the mobile terminal booth of the embodiment 1.
Figure 7:
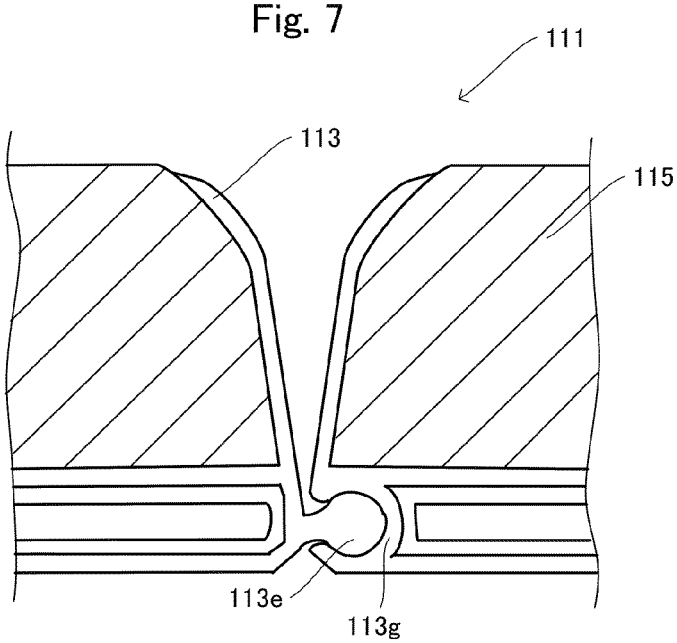
FIG. 7 is a partial cross-sectional view for showing the structure of the plate-like sound absorbing panel used in the mobile terminal booth of the embodiment 1.

As illustrated in the cross sectional view of FIG. 6 and the expanded cross sectional view of FIG. 7, the plate-like sound absorbing panel 111 is provided with a cylindrical lobe 113*e* projected from one side of the aluminum panel 113, and a lobe receptor 113*g* formed in the other side of the aluminum panel 113 and capable of pivotally engaging with the lobe receptor 113*g*. Each adjacent ones of the plate-like sound absorbing panel 111 are linked by inserting and sliding the cylindrical lobe 113*e* into the corresponding lobe receptor 113*g* in the longitudinal direction. The pipes 121 are connected to the plate-like sound absorbing panel 111 by screw clamp on the side surface of the plate-like sound absorbing panel 111.

The plate-like sound absorbing panels 111 are joined in the form of an arc as seen in plan view so that the incident sound waves from the rear and lateral sides can be dumped. On the other hand, the sound waves incident from the front side, i.e., through the opening of the arc cannot be directly dumped. However, this is an important point of the present invention. When a person feels suffocated in a narrow space, it results from reverberating sound in many cases. For example, many people do unexpectedly not feel noisy in an outdoor open place even when a multitude of people are gathered.

This sound absorbing structure is characterized in that incident sound waves are scattered in lateral directions to dump reverberating sound so that the space is felt as if it extending outwards through the panel and also through the wall behind the panel. Accordingly, in the case of this mobile terminal booth having the sound absorbing structure as described in PCT/JP2011/58944 (or WO2006/134654), a comfortable space can be provided without making shrill noise which would be reverberating inside if the booth were designed to form a completely closed structure.

The applicant has made two prototypes of this mobile terminal booth, and verified the sound absorbing capabilities thereof by experiments. The prototypes were placed in a room having an area of 132 square meters and a height of 2.7 meters. The tools for the experiments were Pro tools LE7 (hereinafter referred to as PT) as a recorder and a signal generator, AKG C451 as a microphone, Digidesign 002 as a microphone amplifier and SONY SMS-1P as a powered speaker.

First, the microphone was placed in the center position of the prototypes (i.e., the center of the cylinder formed of the plate-like sound absorbing panels), and the speaker was placed 3 meters distant from the opening of the panel. Pink noise generated by PT was reproduced from the speaker, and the reproduced sound was recorded through the microphone for 30 seconds. The recording format was 24 bits and 48 kHz. The sound data recorded by PT was stored as data of 16 bits and 44.1 kHz, and frequency analyzed (FFT) by "Wave Spectra" which is a Windows (registered trademark) software.

One of the prototypes has been made of twenty four plate-like sound absorbing panels having a width of 10 cm. The other prototype has been made of eight plate-like sound absorbing panels having a width of 30 cm. The height of each type of panel was 60 cm. The same experiments were conducted with a booth made from concrete panels as a comparative example in place of the plate-like sound absorbing panels of the mobile terminal booth.

As experimental results, there were little substantial differences between 10 cm and 30 cm widths of the plate-like sound absorbing panels. However, when the gaps between the plate-like sound absorbing panels increased, there were observed small differences at 1 kHz or higher frequencies which might be influenced by reflection at the gaps.

In the case of the comparative example using the concrete panels, the sound pressure levels were higher than those of the prototypes using the plate-like sound absorbing panels throughout all the frequency range as measured. Particularly, the differential sound pressure levels between the comparative example and the prototypes were up to a maximum of 20 dB in the audible frequency range. These differences were clearly felt by ears. As a result, it was found that the plate-like sound absorbing panel is significantly effective for inhibiting reverberating sound.

Furthermore, comparative experiments were conducted with the plate-like sound absorbing panels having a width of 30 cm and simply arranged in a flat plane to form an absorbing wall, and the same plate-like sound absorbing panels arranged in a cylinder having an opening to form a 270° arc as described above. As a result, there were significant differences around 300 Hz and 550 Hz, and 2 kHz through 4 kH. The frequency components around 300 Hz and 550 Hz correspond to muffled sounds so that, in the case of telephone conversations with cellular phones, it is greatly influenced by these frequency components whether or not voices can be heard clearly. Accordingly, by arranging the panels in a circle, it is understood that voices can be heard easily. This is true also for the person at the other end.

Furthermore, in either experiment, the sound pressure levels at 10 kHz or higher frequencies were higher than those at lower frequencies by about 20 dB. This seems because of sound reflection on the surface of the plate-like sound absorbing panel or sound reflection at the gap between adjacent panels. Incidentally, while the height of each type of panel was 60 cm, the reduction of the sound pressure levels can be further increased by making use of higher panels as well as reflection from the opening.

Meanwhile, the aforementioned structure is effective to dump sound waves other than those reflected inside the mobile terminal booth. For example, the rear (outside) surface of the sound absorbing unit is made of the aluminum panel 113 which reflects and blocks sound waves incident from outside. The aluminum panel 113 therefore improves the sound reduction effect of the mobile terminal booth against the sound waves entering through the mobile terminal booth. A convenient sound field can thereby be provided in which cellular phone users can have telephone conversations with comfort and less stress. Needless to say, the aluminum panel can be replaced with another sound blocking panel such as that made of a metal or alloy, e.g., steel, duralumin, titanium, or a non-metallic material, e.g., reinforced plastic material, wood or the like.

[Embodiment 2]

Figure 8:
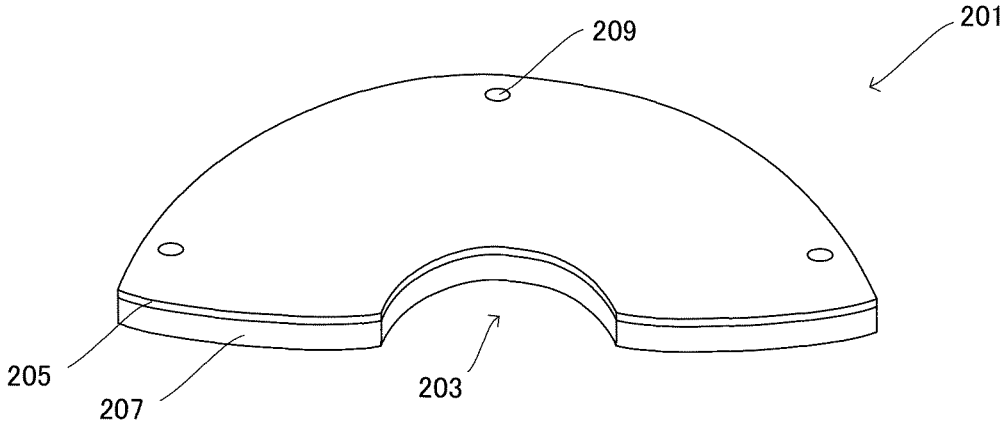
FIG. 8 is a plan view for showing a roof member which is used for the mobile terminal booth of an embodiment 2.
Figure 9:
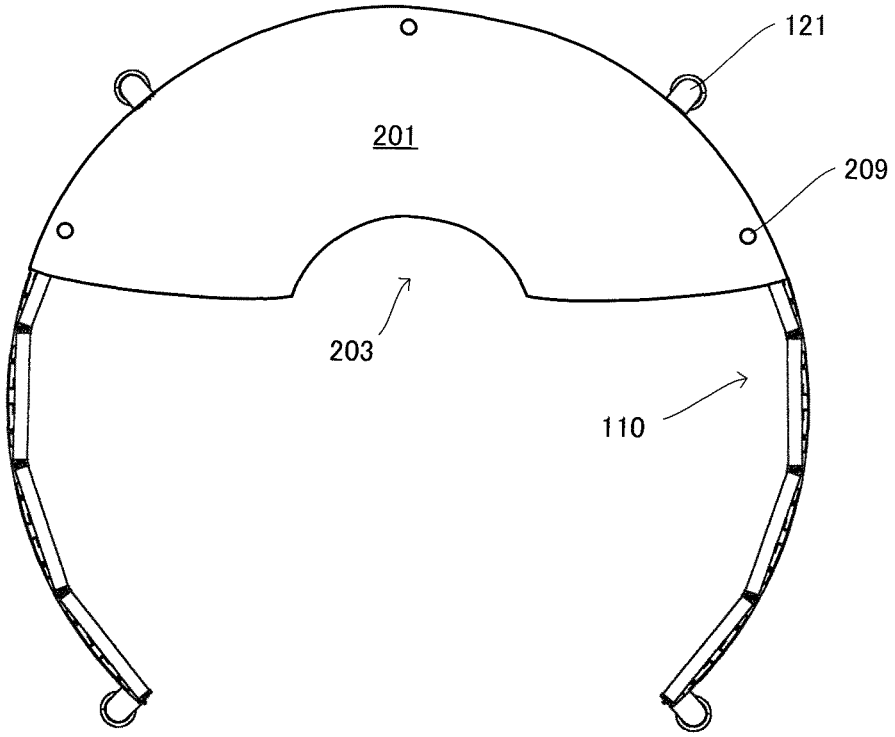
FIG. 9 is a plan view for showing the mobile terminal booth of the embodiment 2.

This embodiment includes a roof member on the top of the mobile terminal booth of the embodiment 1. As illustrated in FIG. 8, this roof member 201 is formed in the shape of a semicircle disk having a semicircular cut-out portion 203. The roof member 201 has a total area covering 30% to 40% of the upper opening of the cylindrical mobile terminal booth. FIG. 9 is a plan view as seen from the above for showing the mobile terminal booth 100 of the embodiment 1 on which the roof member 201 is attached.

The roof member 201 is simply mounted on the mobile terminal booth so that its strength need not be so high. Accordingly, the roof member 201 consists of a sound absorbing member 207 mounted on a base plate 205 made of aluminum or a plastic material such as ABS resin. The sound absorbing member 207 is made of "Room Creator" as described above. The base plate 205 is provided with three through-holes 209 along its periphery, and can be fixed to the mobile terminal booth with screws which are inserted through the through-hole 209 into internal threads (not shown in the figure) which are formed through the panel caps 117.

Figure 10:
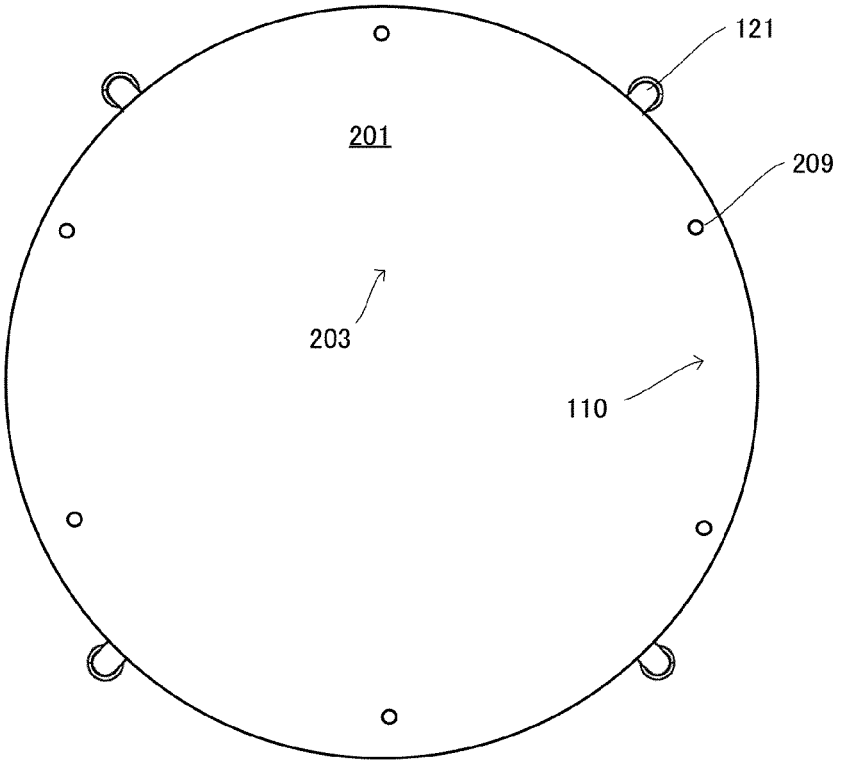
FIG. 10 is a plan view for showing another roof member which is used for the mobile terminal booth of the embodiment 1.

With the roof member 201, it is possible to block sound waves entering from the above and make the inside space more silient. Since the roof member 201 covers only part of the upper opening of the mobile terminal booth rather than all the area of the upper opening, it is possible to have outside light enter the mobile terminal booth and give the inside space an open feeling. However, the roof member 201 may be designed in the form of a disk to cover all the area of the upper opening as illustrated in FIG. 10 and improve the sound blocking performance.

[Embodiment 3]

Figure 11:
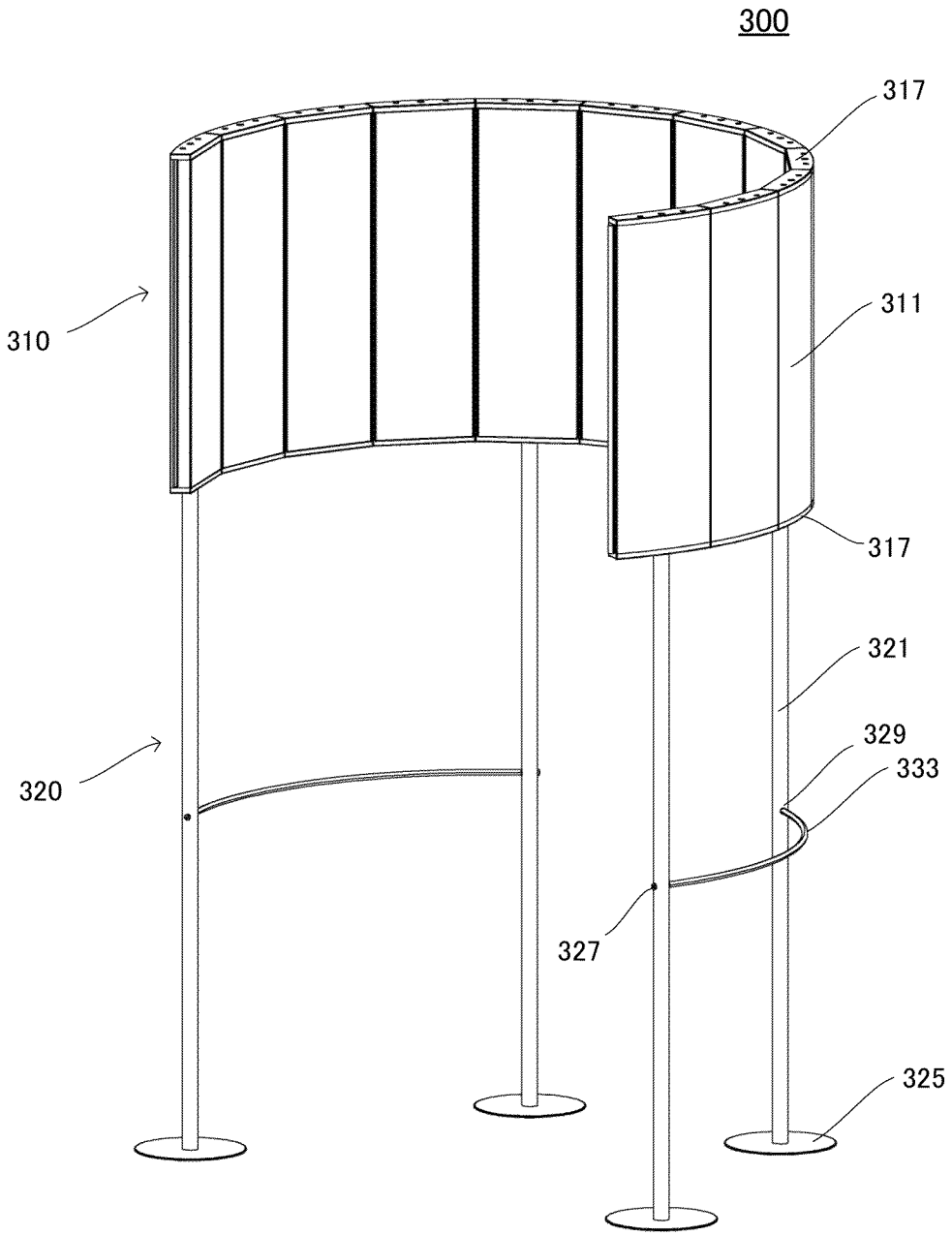
FIG. 11 is a perspective view for showing the mobile terminal booth in accordance with an embodiment 3.

FIG. 11 is a perspective view for showing a mobile terminal booth 300 in accordance with an embodiment 3. The difference between this mobile terminal booth 300 and the mobile terminal booth 100 of the embodiment 1 is that the support frame 120 is replaced with a support frame 320 which is fixed to the bottom of a sound absorbing unit 310. In what follows, the differences from the embodiment 1 will be described.

The sound absorbing unit 310 can be assembled by connecting a number of plate-like sound absorbing panels 311 in the form of an arch. Each sound absorbing panel is, for example, 20 cm wide, 60 cm high and 3 cm thick. Also, the support frame 320 includes four pipes to be vertically connected to the sound absorbing unit 310, two arch members 323 each of which links the centers of two of the pipes 321 together, and disk plates 325 attached to the bottom surfaces of the pipes 321. The disk plates 325 are provided with rubber sheets attached to the bottom surface of the disk plates 325. The length of the pipes 321 is 120 cm.

The tops of the pipes 321 are externally threaded in the form of screws. On the other hand, the panel caps 317 are provided with internally threaded holes (not shown in the figure). The pipes 321 can be fastened to the panel caps 317 by rotating and inserting the screws of the pipes 321 into the threaded holes of the panel caps 317. The pipes 321 are formed with through-holes 329 through which the arch members 323 can be inserted. The arch members 323 can be fixed to the pipes 321 with hex nuts 327 having threaded holes to be engaged with the ends of the arch members 323 which are externally threaded and passed through the through-holes 329.

Figure 12:
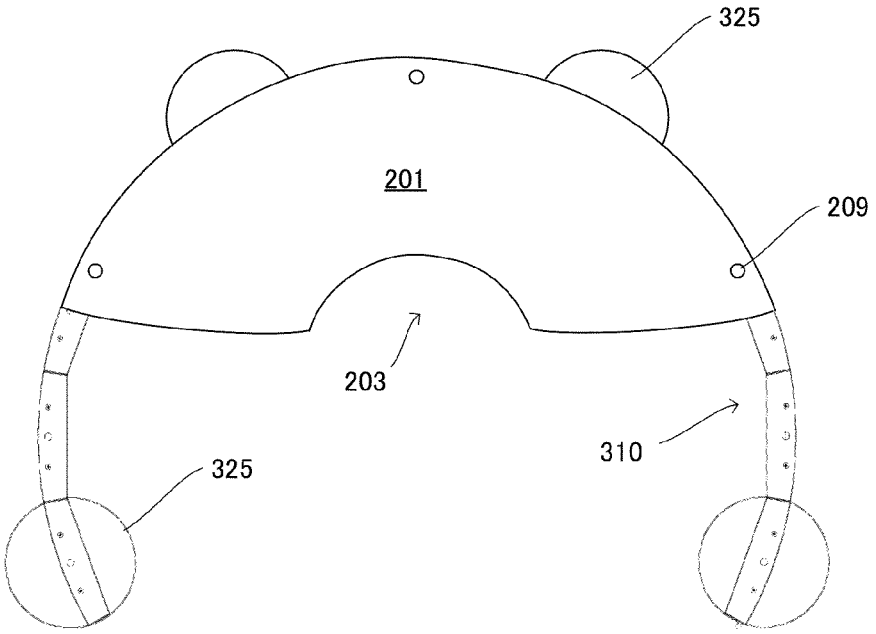
FIG. 12 is a plan view for showing the mobile terminal booth in accordance with the embodiment 3 on which a roof member is mounted.

Furthermore, the lower ends of the pipes 321 are internally threaded (not shown in the figure). On the other hand, externally threaded portions are projected upward from the top surface of the disk plates 325 and can be engaged into the lower ends of the pipes 321 by relative rotation. This structure makes the mobile terminal booth appearing simple and elegant with the sound absorbing unit 310 and having a sufficient strength with the arch members 323. Meanwhile, it is also effective that the roof member 201 as described above is mounted on the mobile terminal booth of this embodiment as illustrated in FIG. 12.

[Embodiment 4]

In what follows, several modifications of the above embodiments will be explained. In the case of the embodiment 1, the sound absorbing unit 110 has a cross section in the form of a circle having an opening. However, the sound absorbing unit can be shaped to have a cross section in the form of a polygon (such as a rectangle, a square, a pentagon) from which one side is removed. One side of this polygon is at least partially opened.

Figure 13:
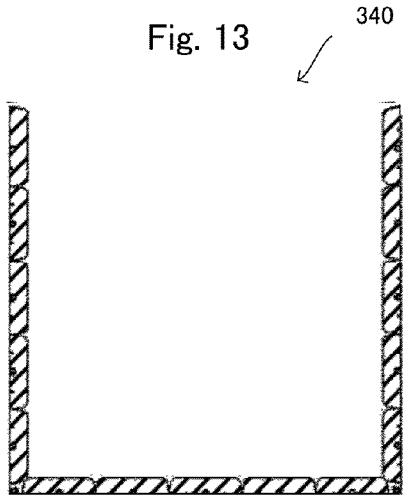
FIG. 13 is a cross sectional view for showing a modification example of the sound absorbing unit of the mobile terminal booth explained as an embodiment 4.

For example, as illustrated in FIG. 13, the space utilization of the sound absorbing unit 340 can be maximized by making use of a squared form to provide more choices of where the mobile terminal booth is placed. Then, the user-friendliness can be improved when assembling, installing and utilizing the mobile terminal booth. Alternatively, as illustrated in FIG. 14, the front opening can be narrowed in order to improve the sound controlling performance.

Figure 14:
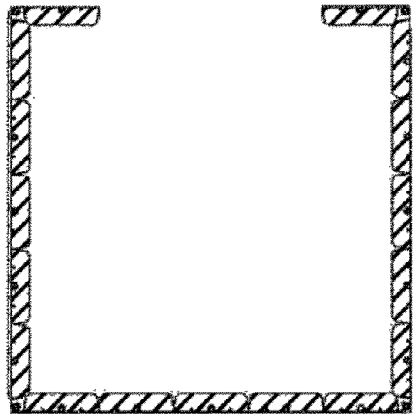
FIG. 14 is a cross sectional view for showing another modification example of the sound absorbing unit of the mobile terminal booth explained as the embodiment 4.

On the other hand, the sound absorbing unit can be shaped in the form of a two-panel screen 350 (or having an L-shaped cross section) as illustrated in FIG. 14. This configuration provides a sense of openness where a user can make use of the mobile terminal booth with ease as if the user simply steps to a wall. In addition, the cost can be minimized.

Figure 15:
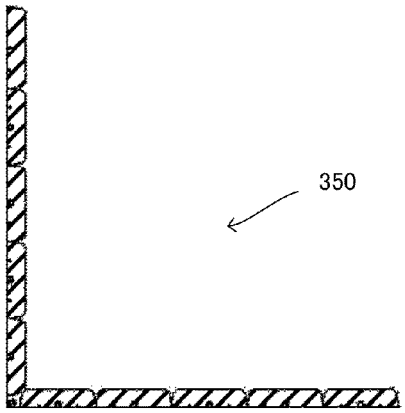
FIG. 15 is a cross sectional view for showing a further modification example of the sound absorbing unit of the mobile terminal booth explained as the embodiment 4.
Figure 16:
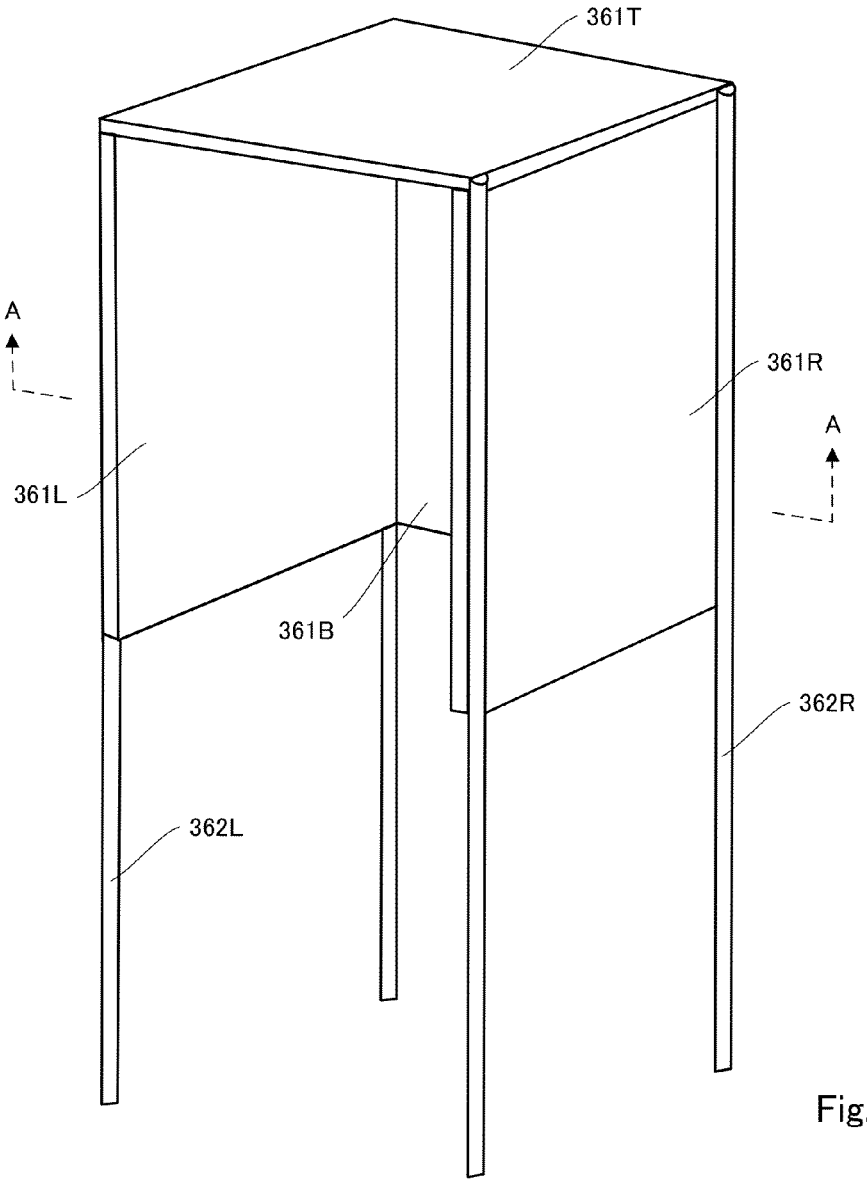
FIG. 16 is a plan view for showing a further modification example of the mobile terminal booth explained as the embodiment 4.
Figure 17:
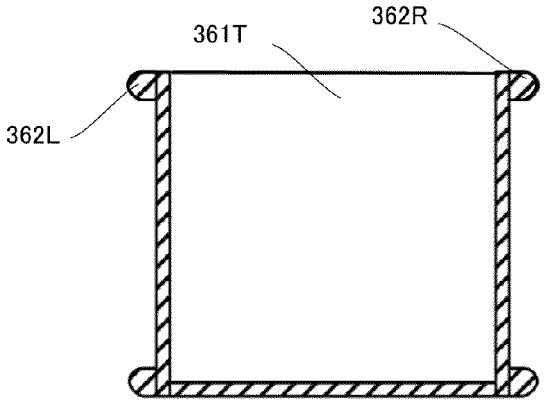
FIG. 17 is a cross sectional view, taken along line A-A of FIG. 16, for showing the sound absorbing unit.

The sound absorbing units as illustrated above can be constructed by basically combining the same plate-like sound absorbing panels. However, the structures as illustrated in FIGS. 13 through 15 can be constructed also by the use of a single larger plate-like sound absorbing panel for each side of the squared form in place of a number of small panels as described above. In this case, the number of steps for assembling a sound absorbing unit can be significantly reduced, and the silent performance can be improved due to a few number of joint portions. FIG. 16 is a perspective view for showing a mobile terminal booth with a sound absorbing unit consisting of left, right and back panels 361L, 361R and 361B each of which is made of a single larger plate-like sound absorbing panel. Also, FIG. 17 is a cross sectional view, taken along line A-A of FIG. 16, for showing the sound absorbing unit of this mobile terminal booth. A pair of support posts 362L are attached to the opposite edges of the left side 361L, and a pair of support posts 362R are attached to the opposite edges of the right side 361R. This mobile terminal booth is provided further with a roof member 361T.

Figure 18:
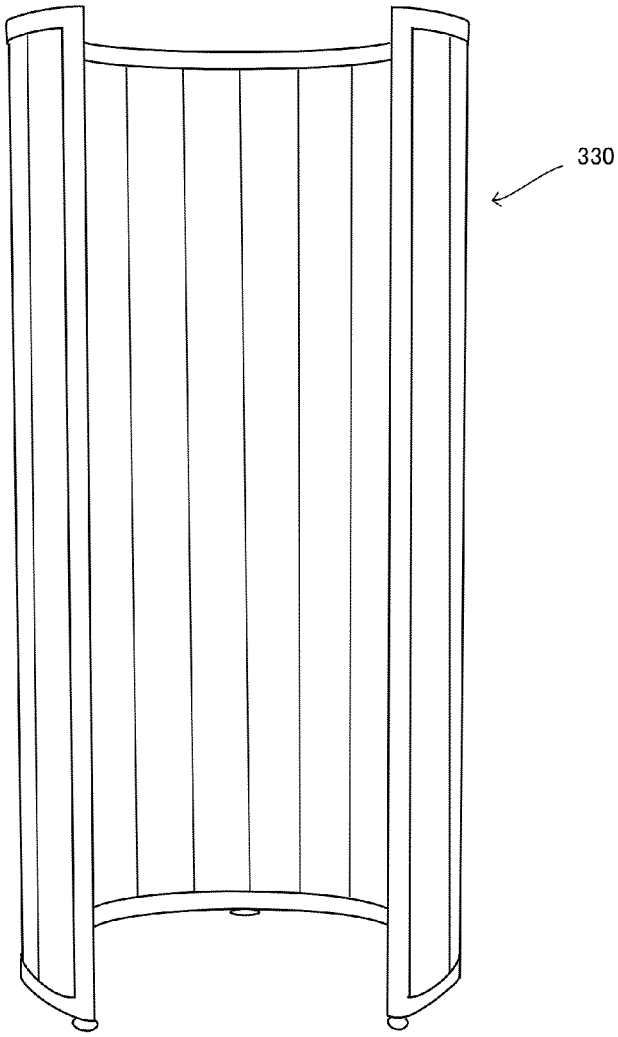
FIG. 18 is a front view for showing a further modification example of the mobile terminal booth explained as the embodiment 4.

Furthermore, the sound absorbing unit 110 of the embodiment 1 can be extended downward to the floor as a sound absorbing unit 330 as illustrated in FIG. 18. In this case, the sound absorbing performance can be furthermore improved such that more quiet space can be created. Particularly, a woman is no longer worried about other people's eyes since her legs are hidden by the sound absorbing unit 330. The roof member 201 of the embodiment 2 can be mounted also on the mobile terminal booth shown in FIG. 18 to create a more quiet space.

Figure 19:
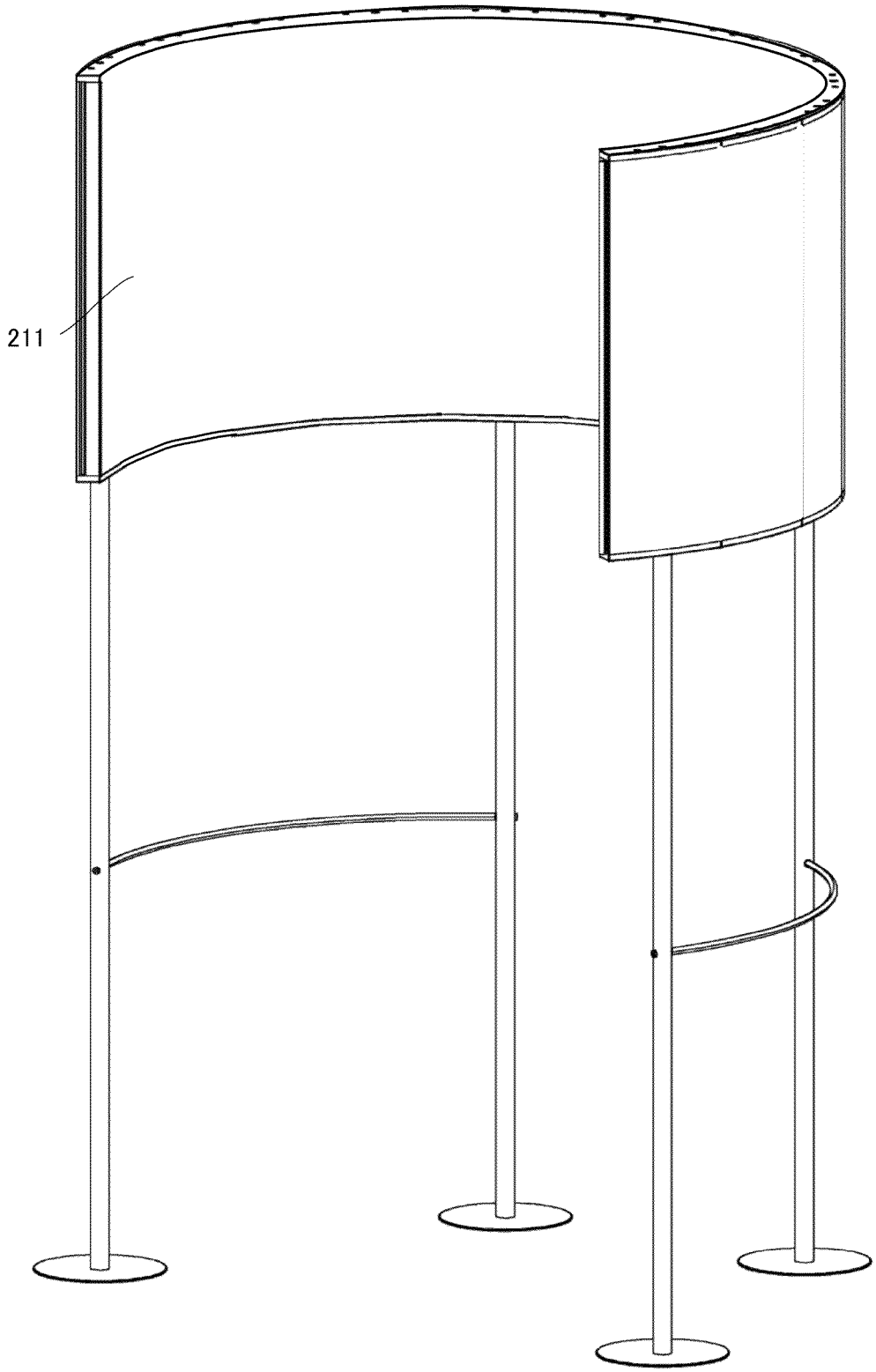
FIG. 19 is a perspective view for showing a further modification example of the mobile terminal booth explained as the embodiment 4.

Furthermore, in the case where a number of plate-like sound absorbing panels are assembled to form a sound absorbing unit as described above, it is inevitable that the reverberating performance and the sound absorbing performance are reduced to some extent at the connecting portions. However, as illustrated in FIG. 19, the influence of the connecting portions can be avoided by making use of a single cylindrical plate-like sound absorbing panel 211 from which an entrance portion is cut out. In this case, the plate-like sound absorbing panel 211 can continuously cover the inner space without connecting portions.

[Embodiment 5]

Figure 20:
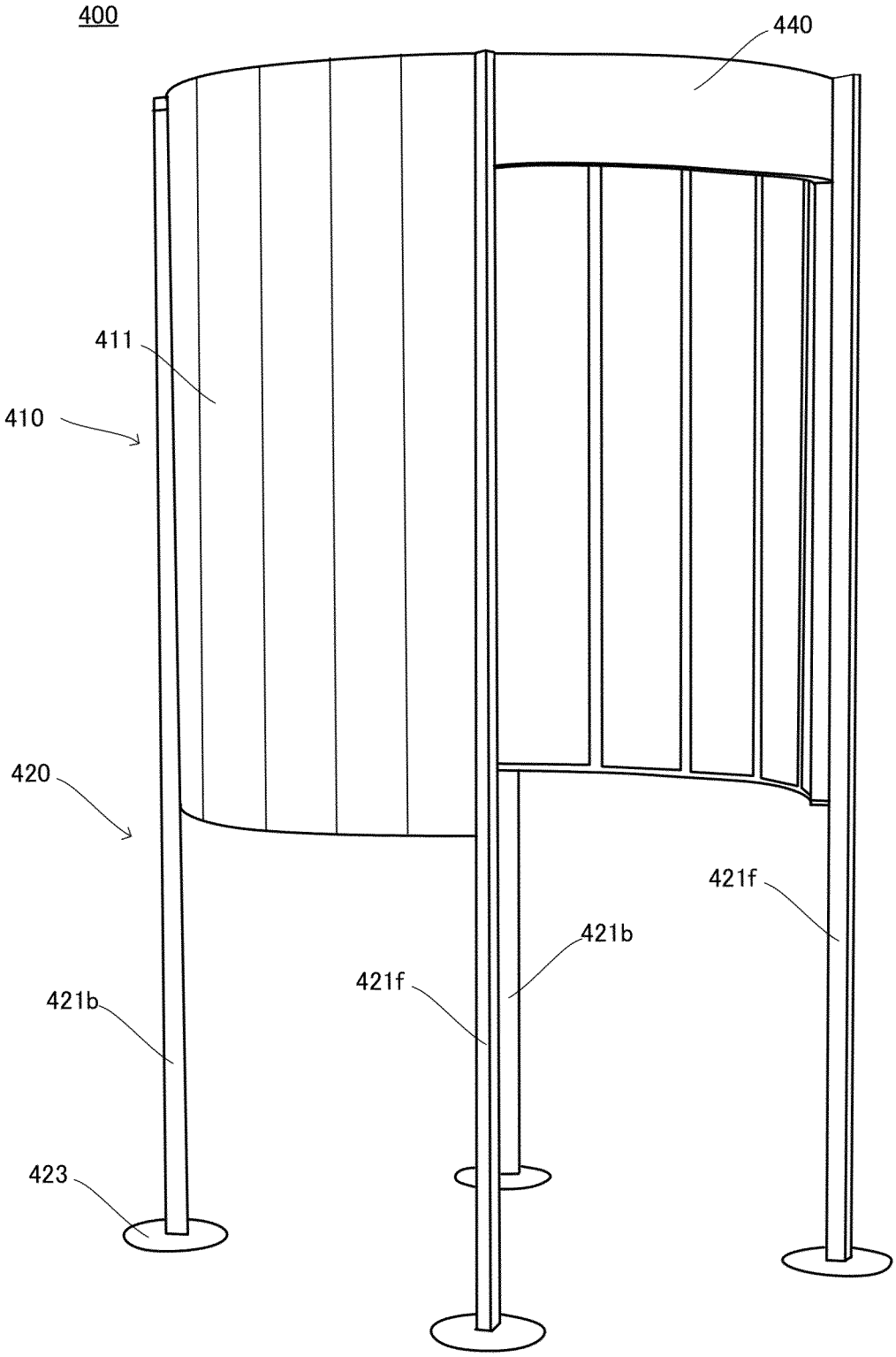
FIG. 20 is a perspective view for showing a mobile terminal booth in accordance with an embodiment 5 of the present invention.

FIG. 20 is a perspective view for showing a mobile terminal booth in accordance with a fifth embodiment of the present invention. This mobile terminal booth 400 includes a sound absorbing unit 410 in the form of a cylinder having a front opening, and a support frame 420 for supporting the sound absorbing unit 410, in the same manner as the mobile terminal booth of the embodiment 1. Each of the sound absorbing unit 410 and the support frame 420 can be carried as several constituent parts and assembled in an installation site.

The sound absorbing unit 410 can be assembled by connecting a number of plate-like sound absorbing panels 411 in the form of an arch. Each sound absorbing panel is, for example, 20 cm wide, 60 cm high and 3 cm thick. Also, the support frame 420 includes four pipes 421*b* and 421*f* to be vertically connected to the sound absorbing unit 410, and adjuster foots 423 attached to the bottom surfaces of the pipes 421*b* and 421*f*.

If the length of the pipes 421*b* and 421*f* is 200 cm, the lower end of the sound absorbing unit 410 is located 80 cm from the floor. The sound absorbing unit 410 has the same structure as that of the embodiment 1 except for its size. Additionally, a roof member as shown in FIG. 10 is provided on the top of the sound absorbing unit 410.

Furthermore, the mobile terminal booth of this embodiment is provided with an arch-like connector 440 which bridges between the upper portions of the plate-like sound absorbing panels located at opposite sides of the front opening (entrance) of the sound absorbing unit 410. This arch-like connector 440 serves to reinforce the stability of the mobile terminal booth. Accordingly, while the plate-like sound absorbing panels 411 are pivotally joined with each other, the diameter of the mobile terminal booth can be changed by making use of an arch-like connector having a different span as the arch-like connector 440.

Figure 21:
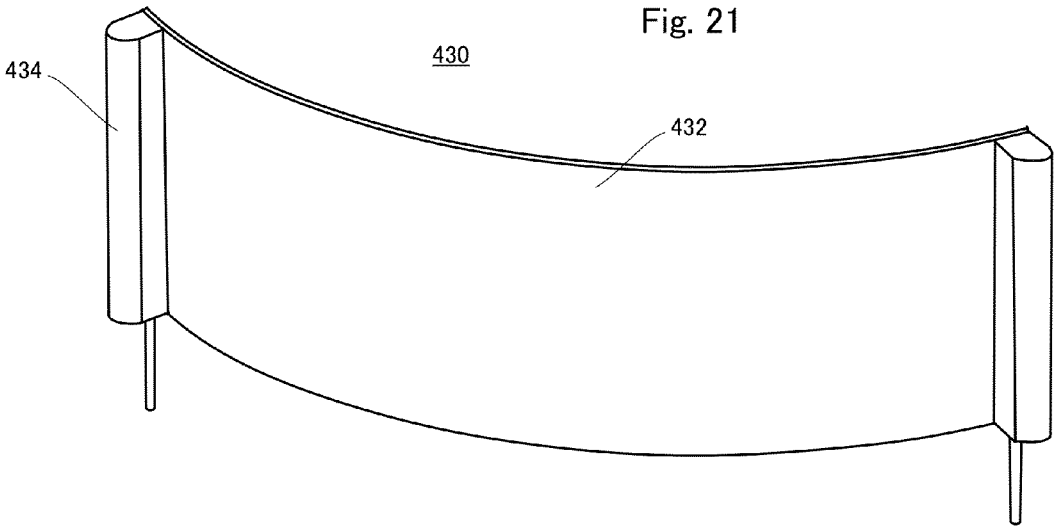
FIG. 21 is a perspective view for showing a replaceable billboard which can be attached to the mobile terminal booth of the embodiment 5.

Furthermore, the inner and outer surfaces of the sound absorbing unit may be used as an advertising space so that certain earnings can be expected. The mobile terminal booth of the embodiment 5 is further provided with a replaceable billboard. FIG. 21 is a perspective view for showing this replaceable billboard. As shown in this figure, the replaceable billboard 430 consists of an advertisement plate 432 made of a plastic and a pair of supporting poles 434 to which the opposite ends of the advertisement plate 432 are fixed.

Figure 22:
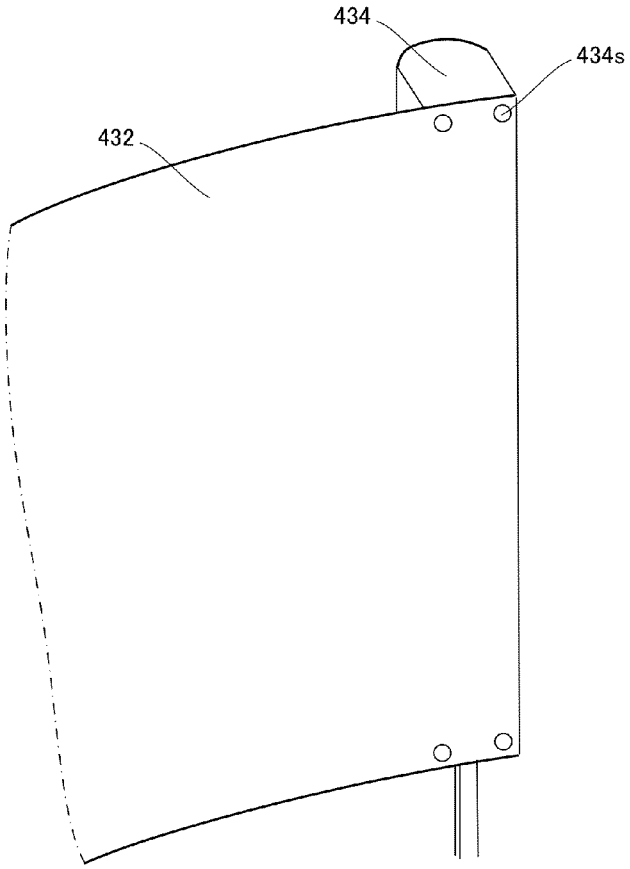
FIG. 22 is a perspective expanded view for partially showing the replaceable billboard shown in FIG. 21 as seen from the back side.
Figure 23:
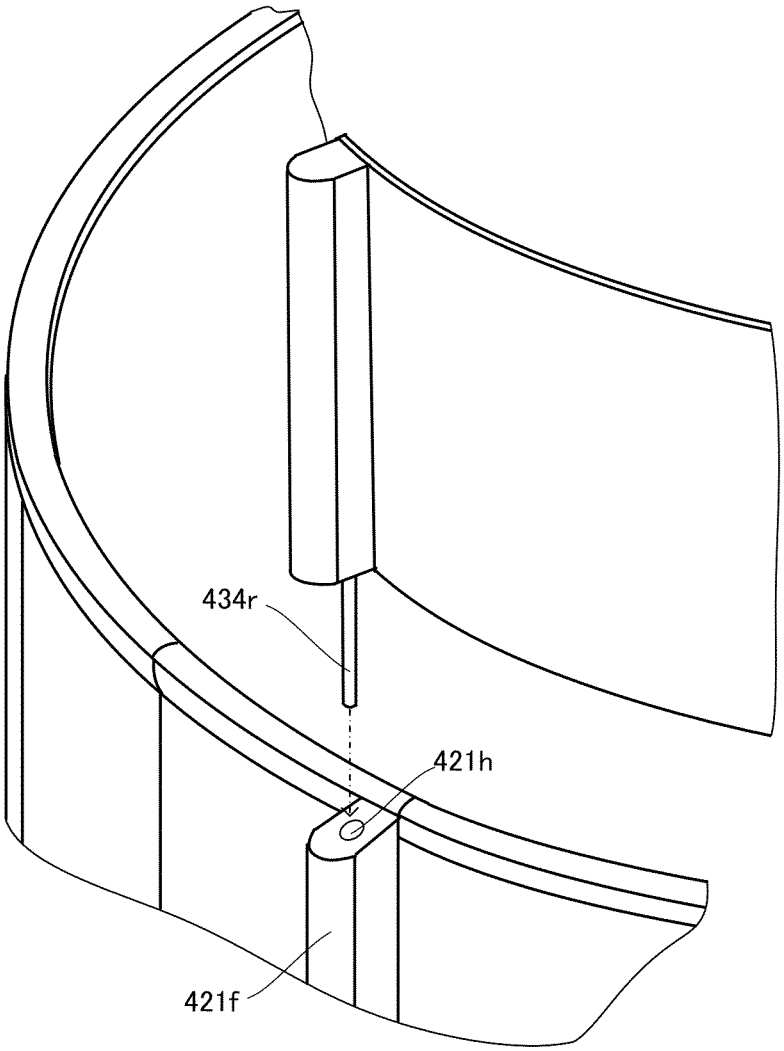
FIG. 23 is a perspective expanded partial view for showing the way of mounting the replaceable billboard shown in FIG. 21 on the mobile terminal booth of the embodiment 5.
Figure 24:
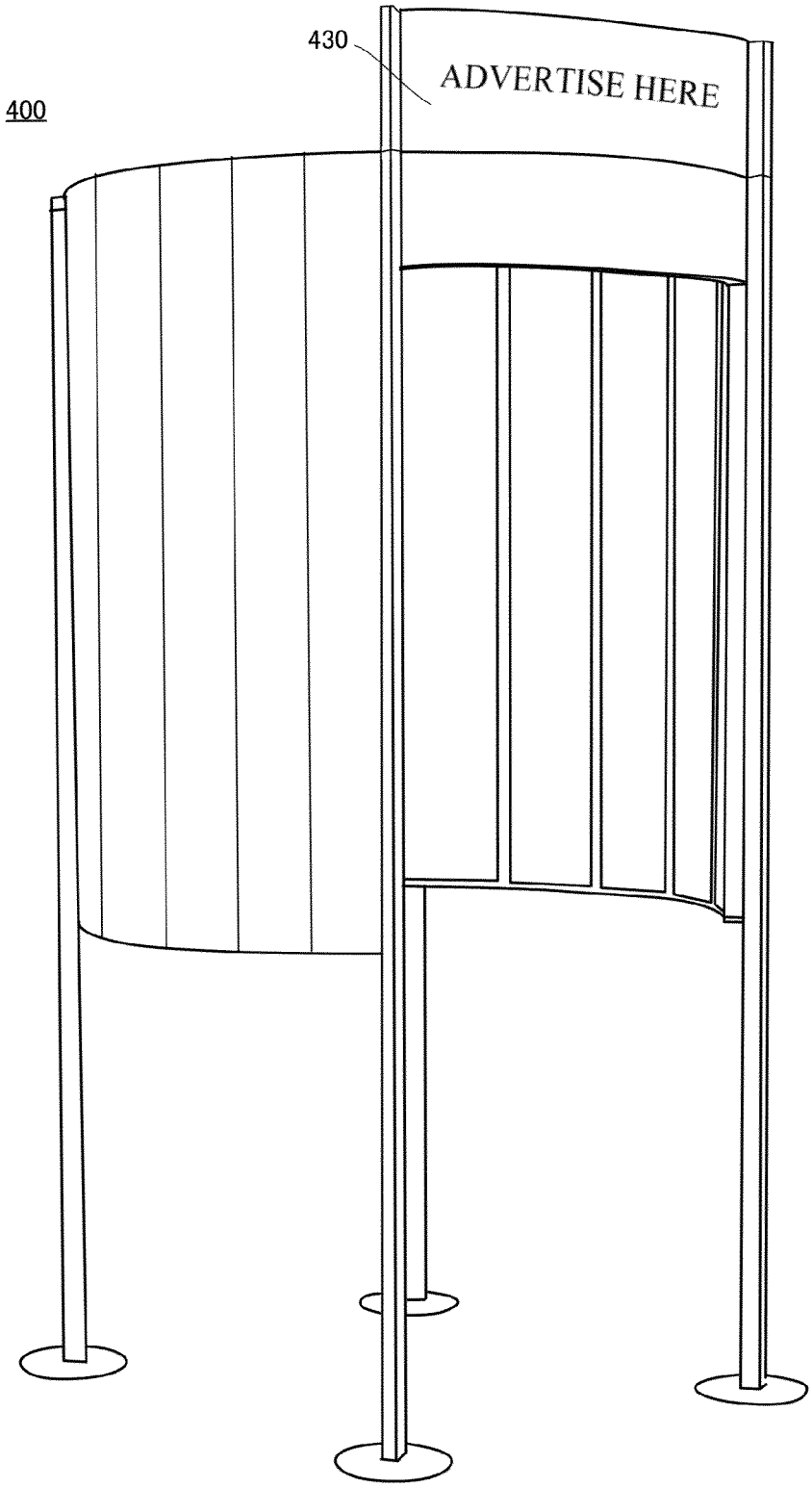
FIG. 24 is a perspective view for showing the mobile terminal booth of the embodiment 5 on which the replaceable billboard shown in FIG. 21 is mounted.

As illustrated in FIG. 22, the advertisement plate 432 is fixed to the supporting poles 434 with screws 434*s*, and can be replaced with another advertisement plate. Also, as illustrated in FIG. 23, the two front side pipes 421*f* are provided with support holes 421*h* at their upper ends. On the other hand, the supporting poles 434 are provided with support rods 434*r* which are projected downward and inserted into the support holes 421*h* of the front side pipes 421*f* so that the replaceable billboard 430 can be mounted on the top of the sound absorbing unit 410 as illustrated in FIG. 24.

Figure 25:
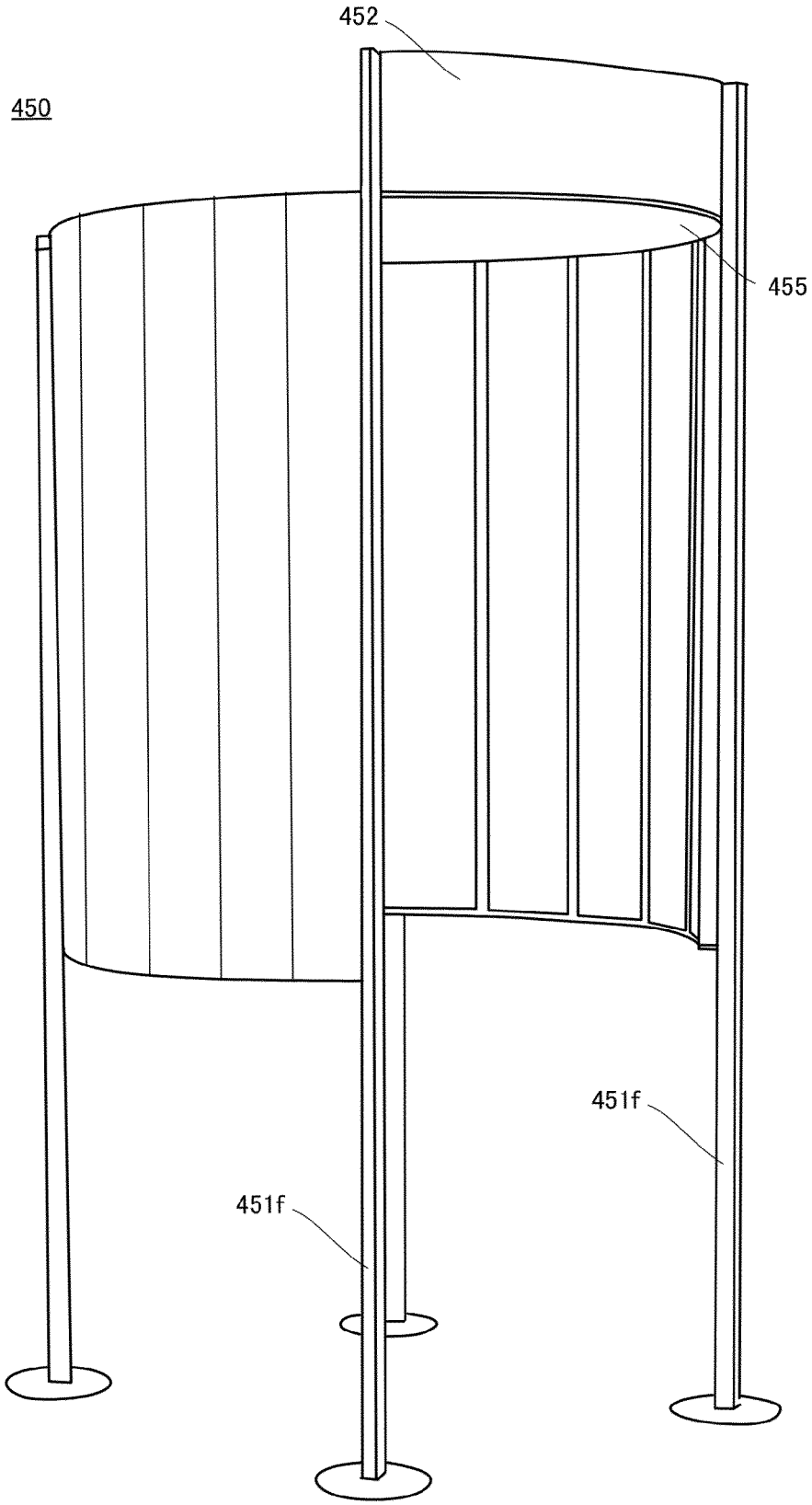
FIG. 25 is a perspective view for showing a modification the mobile terminal booth in accordance with the embodiment 5.

FIG. 25 is a perspective view for showing a modification the mobile terminal booth in accordance with the fifth embodiment. This mobile terminal booth 450 is provided with an arch-like connector 452 in place of the arch-like connector 440 as shown in FIG. 20. The arch-like connector 452 is provided to project upward from the top of the sound absorbing unit 410 in the position corresponding to the replaceable billboard 430 as illustrated in FIG. 24. More specifically, the mobile terminal booth 450 has front two pipes 451*f* which are extending upwards beyond a roof member 455 in the same manner as the supporting poles 434 of the mobile terminal booth 400 shown in FIG. 24. The arch-like connector 452 is fixed between the extended portions of the pipes 451*f*. This arch-like connector 452 serves to reinforce the stability of the mobile terminal booth without narrowing the front opening (entrance) of the sound absorbing unit 450.

[Embodiment 6]

Figure 26:
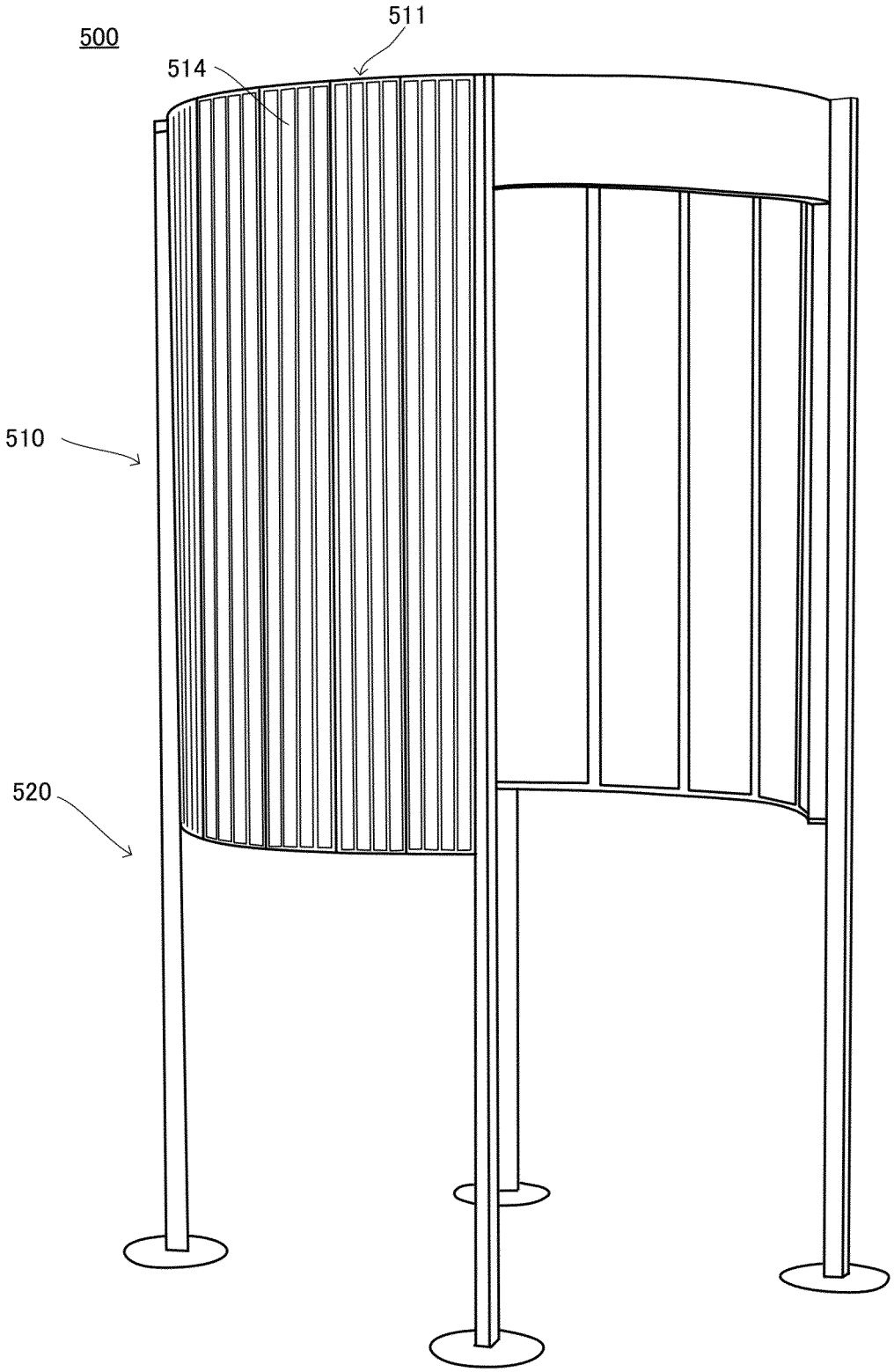
FIG. 26 is a perspective view for showing a mobile terminal booth in accordance with an embodiment 6 of the present invention.

FIG. 26 is a perspective view for showing a mobile terminal booth in accordance with a sixth embodiment of the present invention. This mobile terminal booth 500 differs from the mobile terminal booth of the embodiment 1 in the structure of the sound absorbing unit. Specifically speaking, plate-like sound absorbing panels 511 have a different structure.

Figure 27:
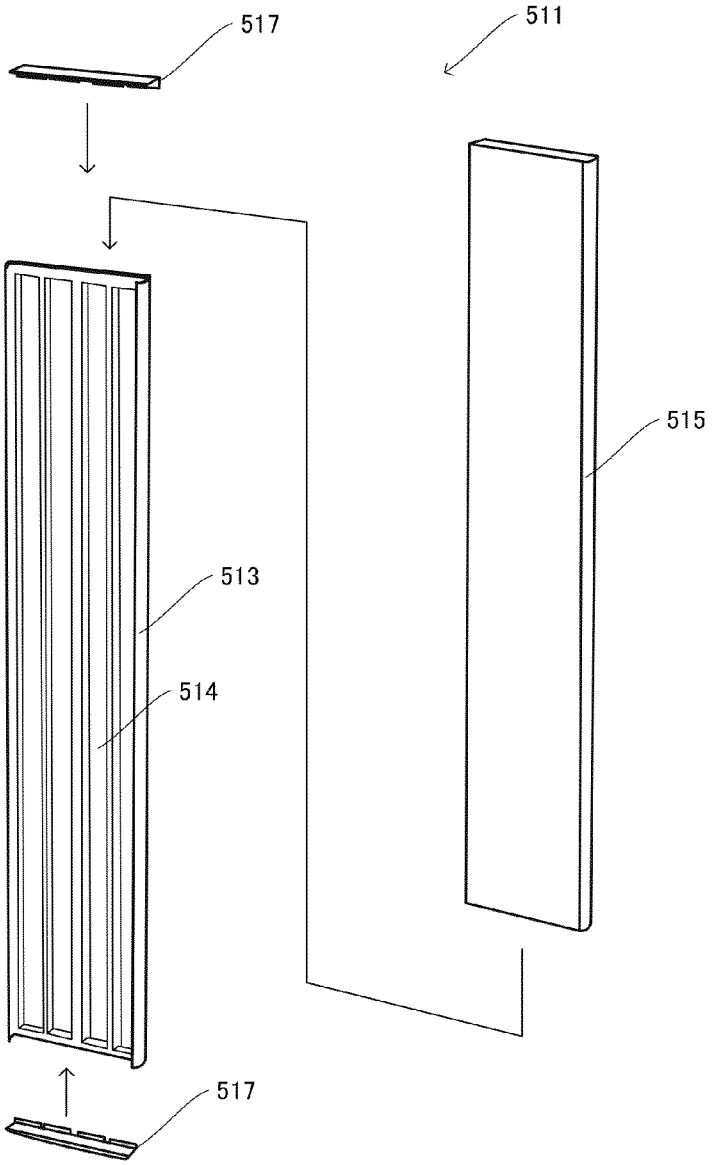
FIG. 27 is an exploded perspective view for showing the structure of the plate-like sound absorbing panel in accordance with the embodiment 6.
Figure 28:
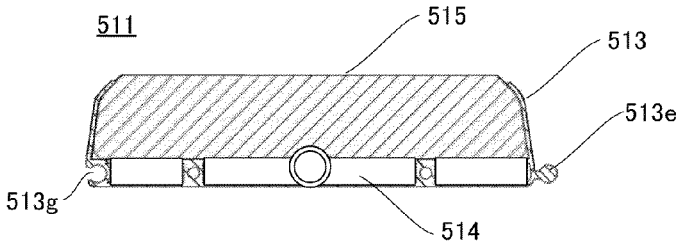
FIG. 28 is a cross sectional view for showing the structure of the plate-like sound absorbing panel used in the mobile terminal booth of the embodiment 6.

FIG. 27 is an exploded perspective view for showing the plate-like sound absorbing panel 511 of this mobile terminal booth 500. FIG. 28 is a cross sectional view for showing the plate-like sound absorbing panel 511. The plate-like sound absorbing panel 511 is assembled by mounting a sound absorbing member 515 on an aluminum panel 513 in the same manner as that of the embodiment 1.

However, the outer side of the aluminum panel 513 is at least partially opened. In this case, a plurality of vertical slits 514 are formed through the aluminum panel 513. Namely, the front side of the aluminum panel 513 is in the form of a grille through which the inside sound absorbing member 515 is exposed. Except for the formation of the grille, the plate-like sound absorbing panel 511 is the same as the plate-like sound absorbing panel 111 of the embodiment 1. As compared with the structure shown in FIG. 2, this structure shown in FIG. 27 is less effective to reflect and block sound waves incident from outside, but more effective to inhibit reverberating sound inside the mobile terminal booth. Namely, in the case of the first embodiment, the inner surface of the aluminum panel 113 reflects sound waves that are propagating from the inside space of the mobile terminal booth, passed through the sound absorbing member 115 and incident on the inner side the sound absorbing panel 111, and thereby enhances reverberating sound in the inside space. However, in the case of this embodiment, such sound waves incident on the inner side the sound absorbing panel 111 are transmitted through the vertical slits 514 of the aluminum panel 513 outwards from the inside space of the mobile terminal booth, so that reverberating sound can be inhibited.

Figure 29:
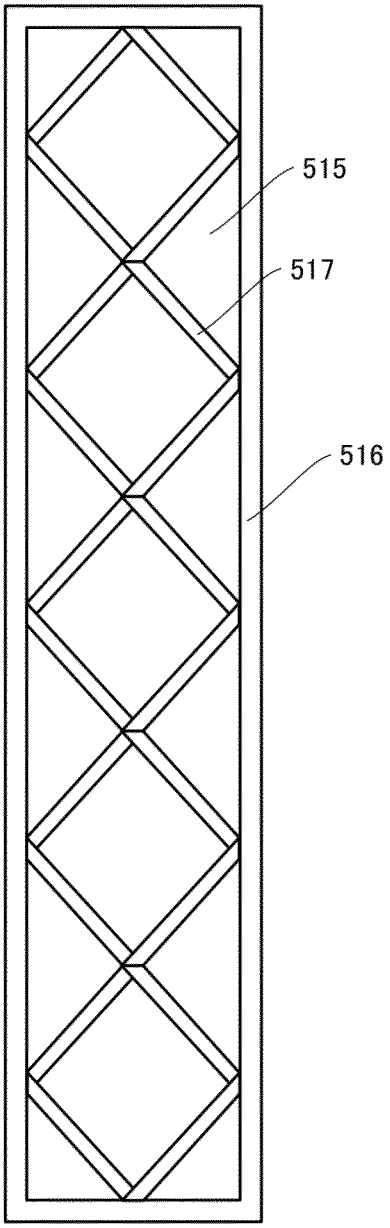
FIG. 29 is a plan view for showing another example of the plate-like sound absorbing panel used in the mobile terminal booth of the embodiment 6.

Accordingly, the grille 513*g* serves to reduce reverberating sound waves which contains much high-frequency components, and thereby can function as a means of controlling sound inside the mobile terminal booth. Generally speaking, it is effective for the same purpose to (partially) remove the center portion of the aluminum panel 513. For example, FIG. 29 shows another example of such an aluminum panel from which the center portion thereof is removed. The aluminum panel consists of an outer rim 516 and a plurality of strips 517 inside the rim in the form of a criss-crossed pattern. The sound absorbing member 515 is exposed through the criss-crossed pattern.

The mobile terminal booth of the present invention may be used to serve also as a guide booth which is installed, for example, in a crowded street, a crowded indoor or outdoor area or the like to provide people speech guidance. Also, a touchscreen with a touch panel such as a tablet computer may be mounted on the inner side of the sound absorbing unit of the mobile terminal booth (for example, the inner surface of the arch-like connector 440 shown in FIG. 20) to provide speech guidance together with visual guidance. Furthermore, if an Internet connectivity function and a stationary videophone system are implemented in the touchscreen, it is possible to have a video teleconference.

In accordance with the mobile terminal booth of the present invention, a space suitable for using mobile terminals can be provided to raise convenience of users of mobile terminals. For example, if the mobile terminal booth is installed in a lobby of a hotel, guests can comfortably use mobile terminals, and manners are improved to make better the atmosphere in the hotel. Furthermore, the outer side of the sound absorbing unit may be used as an advertising space so that certain earnings can be expected. For example, a speaker is installed in the mobile terminal booth for running an audio commercial. This audio commercial may always be running, but halted a predetermined period after detecting a user who enters the mobile terminal booth by a human sensor in order not to hinder conversation. This predetermined period is no longer than thirty seconds, for example, three seconds to twenty seconds, preferably five seconds to ten seconds. When the user exits the mobile terminal booth, the audio commercial resumes. Music may be associated with this commercial.

In accordance with the mobile terminal booth of the present invention, the sound absorbing unit partially confines and provide a private space where a mobile terminal can be used in a comfortable manner. The mobile terminal booth consists mainly of a sound absorbing unit confining a private space with an entrance opening, so that users do not feel suffocated in a narrow space with unpleasant reverberating sound and can have telephone conversations with comfort and less stress. Furthermore, the voice does not leak in the backward and lateral directions beyond the sound absorbing unit, and is absorbed in the mobile terminal booth without being reflected in the forward direction. Accordingly, the user need hardly worry about others who may hear conversation, and cause a nuisance to others nearby even if speaking loudly. On the other hand, the person at the other end of conversation can hear the voice clearly without reflection noise.

The foregoing description of the embodiments has been presented for purposes of illustration and description. It is not intended to be exhaustive or to limit the invention to the precise form described, and obviously many modifications and variations are possible in light of the above teaching. The embodiment was chosen in order to explain most clearly the principles of the invention and its practical application thereby to enable others in the art to utilize most effectively the invention in various embodiments and with various modifications as are suited to the particular use contemplated.

What is claimed is:

1. A mobile terminal booth comprising:

a sound absorbing unit which is placed in a public place and partially partitions a space as viewed from the above where a user of a mobile terminal can have a telephone conversation, wherein said sound absorbing unit is provided with an entrance which is always opened without any closing member, wherein said sound absorbing unit is provided with a sound controlling member, and wherein said sound absorbing unit is made of a laminate consisting of a plurality of sound absorbing layers, and wherein said sound absorbing layers are joined together in the form of said laminate with an adhesive said adhesive is a viscous adhesive which does not solidify after formation of said laminate, maintains viscosity when the mobile terminal booth is used and functions as said sound controlling member.

2. The mobile terminal booth of claim 1 wherein said sound absorbing unit includes a sound absorbing layer.

3. The mobile terminal booth of claim 2 wherein said sound absorbing layers are made from at least one of a needle felt, bestray, softray, glass wool, thermo wool, phenol resin, and polyurethane.

4. The mobile terminal booth of claim 1 wherein said laminate is formed with a resin sheet interposed between each adjacent ones of said sound absorbing layers.

5. The mobile terminal booth of claim 4 wherein said resin sheet is a vinyl film having a thickness of 0.1 mm to 0.5 mm.

6. The mobile terminal booth of claim 4 wherein said resin sheet is provided with a plurality of openings, and wherein said sound absorbing layers are directly adhered with each other by said adhesive through said openings, and indirectly adhered with each other by said adhesive through said resin sheet.

7. The mobile terminal booth of claim 1 further comprising:

a plurality of support posts which support said sound absorbing unit at a predetermined height.

8. The mobile terminal booth of claim 1 wherein said sound absorbing unit consists of a plurality of sound absorbing panels which are joined to confine said partitioned space.

9. The mobile terminal booth of claim 8 wherein said sound absorbing panel includes a sound absorbing member and a support panel on which said sound absorbing member is mounted, and the outer side of said support panel is at least partially opened.

10. The mobile terminal booth of claim 9 wherein said support panel is made of aluminum.

11. The mobile terminal booth of claim 1 wherein the outer side of said support panel serves as a sound blocking surface.

12. The mobile terminal booth of claim 1 further comprising:

a roof member which covers the top of said mobile terminal booth and encloses the inside space of said mobile terminal booth from the above.

13. The mobile terminal booth of claim 1 wherein said sound absorbing unit is in the form of an arc in a plan view.

14. The mobile terminal booth of claim 1 wherein said sound absorbing unit is in the form of a polygon in a plan view.

15. The mobile terminal booth of claim 14 wherein said polygon is a rectangle, a square or a pentagon, whose one side is at least partially opened.

16. A mobile terminal booth comprising:

a sound absorbing unit which is placed in a public place and partially partitions a space as viewed from the above where a user of a mobile terminal can have a telephone conversation, wherein said sound absorbing unit is provided with an entrance which is always opened without any closing member, wherein said sound absorbing unit is provided with a sound controlling member, wherein said sound absorbing unit is made of a laminate consisting of a plurality of sound absorbing layers, wherein said sound absorbing layers are joined together in the form of said laminate with an adhesive, and wherein said laminate is formed with a resin sheet interposed between each adjacent ones of said sound absorbing layers.

17. The mobile terminal booth of claim 16 wherein said resin sheet is a vinyl film having a thickness of 0.1 mm to 0.5 mm.

18. The mobile terminal booth of claim 16 wherein said resin sheet is provided with a plurality of openings, and wherein said sound absorbing layers are directly adhered with each other by said adhesive through said openings, and indirectly adhered with each other by said adhesive through said resin sheet.

19. The mobile terminal booth of claim 16 further comprising:

a plurality of support posts which support said sound absorbing unit at a predetermined height.

20. The mobile terminal booth of claim 16 wherein said sound absorbing unit consists of a plurality of sound absorbing panels which are joined to confine said partitioned space.

21. The mobile terminal booth of claim 20 wherein said sound absorbing panel includes a sound absorbing member and a support panel on which said sound absorbing member is mounted, and the outer side of said support panel is at least partially opened.

22. The mobile terminal booth of claim 21 wherein said support panel is made of aluminum.

23. The mobile terminal booth of claim 16 wherein the outer side of said support panel serves as a sound blocking surface.

24. The mobile terminal booth of claim 16 further comprising:

a roof member which covers the top of said mobile terminal booth and encloses the inside space of said mobile terminal booth from the above.

25. The mobile terminal booth of claim 16 wherein said sound absorbing unit is in the form of an arc in a plan view.

26. The mobile terminal booth of claim 16 wherein said sound absorbing unit is in the form of a polygon in a plan view.

27. The mobile terminal booth of claim 26 wherein said polygon is a rectangle, a square or a pentagon, whose one side is at least partially opened.

* * * * *